US007341463B2

(12) United States Patent
Lai

(10) Patent No.: US 7,341,463 B2
(45) Date of Patent: Mar. 11, 2008

(54) EXTENSION SOCKET STRUCTURE

(76) Inventor: Li-Chun Lai, 21F-1, No. 33, Sec. 1 Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 11/462,376

(22) Filed: Aug. 4, 2006

(65) Prior Publication Data

US 2008/0032528 A1 Feb. 7, 2008

(51) Int. Cl.
*H01R 13/44* (2006.01)

(52) U.S. Cl. ..... 439/131; 439/501; 439/543; 174/484; 174/57

(58) Field of Classification Search ..... 439/131, 439/501, 543, 528, 542, 536; 174/484, 57, 174/486
See application file for complete search history.

(56) References Cited

U.S. PATENT DOCUMENTS 3,433,886 A * 3/1969 Myers ..... 174/57
4,059,321 A * 11/1977 Rasmussen et al. ..... 439/131
4,551,577 A * 11/1985 Byrne ..... 174/57
5,023,396 A * 6/1991 Bartee et al. ..... 174/486
5,888,078 A * 3/1999 Lecreux et al. ..... 439/131
6,234,812 B1 * 5/2001 Ivers et al. ..... 439/131
6,416,336 B1 * 7/2002 Schulte et al. ..... 439/131
7,004,786 B1 * 2/2006 Bloom et al. ..... 439/501
7,163,409 B1 * 1/2007 Chen et al. ..... 439/131
2003/0186581 A1 * 10/2003 Hsiao ..... 439/501
2004/0063076 A1 * 4/2004 Van Leest ..... 434/60

* cited by examiner

*Primary Examiner*—Gary F. Paumen

(57) ABSTRACT

An extension socket structure includes a positioning sleeve, which has a front face with an opening disposed thereon and a rear face having a plurality of positioning slots disposed thereon, and an extension socket being inserted in the positioning sleeve for a socket panel of the body of the extension socket to protrude from the opening of the positioning sleeve. Thus it allows for an insertion of a plug of an electrical appliance to the extension socket. Besides, a bottom of the positioning sleeve is coupled to a cone for fixing the extension socket to a lawn or sands to provide outdoor use. When the extension socket is not in use, a wire of the extension socket can be wound along the plurality of positioning slots of the rear face of the positioning sleeve to let the positioning sleeve to act as a collecting wheel.

5 Claims, 7 Drawing Sheets

EXTENSION SOCKET STRUCTURE

BACKGROUND OF THE INVENTION

1. Field of the Invention

The present invention is related to an extension socket structure, and more particularly, to an extension socket structure for outdoor or indoor use based on users' requirements.

2. Description of the Prior Art

Extension sockets have been widely used for providing additional power outlets to indoor electrical appliances, light bulbs hanging outside in the trees or electrical machinery operated by outdoor workers. Therefore, extension sockets have become tools for daily use for almost every household.

However, traditional extension sockets have some disadvantages, such as:

1. Traditional extension sockets usually provide long power cables, which makes it difficult to organize when the extension sockets are not in use.
2. Traditional extension sockets are not applicable for both indoor and outdoor uses; therefore, structural modification or adjustment is required for different application and fields.

Therefore, the above-mentioned traditional extension sockets present several shortcomings to be overcome.

In view of the above-described deficiencies of traditional extension sockets, after years of constant effort in research, the inventor of this invention has consequently developed and proposed an extension socket structure in the present invention.

SUMMARY OF THE INVENTION

The present invention is to provide an extension socket structure, which places the extension socket inside a positioning sleeve and winds the power cable of the extension socket around the positioning sleeve to provide a convenient way to keep the extension socket.

Another, the present invention is to provide an extension socket structure, which places the extension socket inside a positioning sleeve and has a cone screwed to the bottom of the positioning sleeve and implemented for fixing the extension socket to a lawn, a ground or sands to provide outdoor use.

The present invention provides an extension socket structure, comprises an extension socket and a positioning sleeve, the positioning sleeve having a first rim extending from a top end and a second rim extending from a bottom end of the positioning sleeve to slightly form an I shape, and the first rim having a slot disposed thereon, an opening being disposed on a front face of the positioning sleeve and joining with the slot of the first rim, and a plurality of positioning slots being disposed on a rear face of the positioning sleeve. The extension socket is inserted in the positioning sleeve for a socket panel on the extension socket to protrude from the opening of the positioning sleeve. The positioning sleeve has a cone screwed to a bottom and implemented for fixing the extension socket to a lawn, a ground or sands to provide outdoor use. Besides, when the extension socket is not in use, a power cable of the extension socket can be wound along the plurality of positioning slots of the rear face of the positioning sleeve to let the positioning sleeve to act as a collecting wheel for providing a convenient way to keep the extension socket.

These features and advantages of the present invention will be fully understood and appreciated from the following detailed description of the accompanying Drawings.

DETAILED DESCRIPTION OF THE PREFERRED EMBODIMENT

Figure 1A:
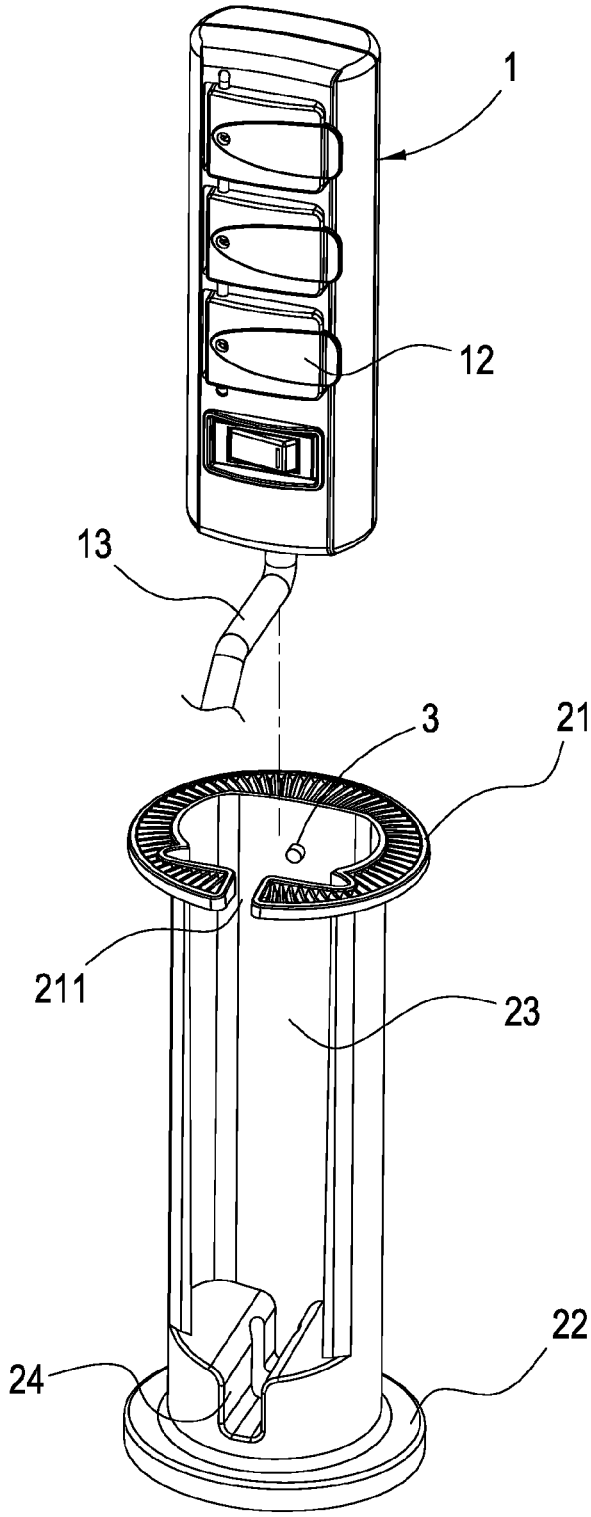
FIG. 1A and FIG. 1B illustrate decomposing diagrams of an extension socket structure disclosed in the present invention.
Figure 1B:
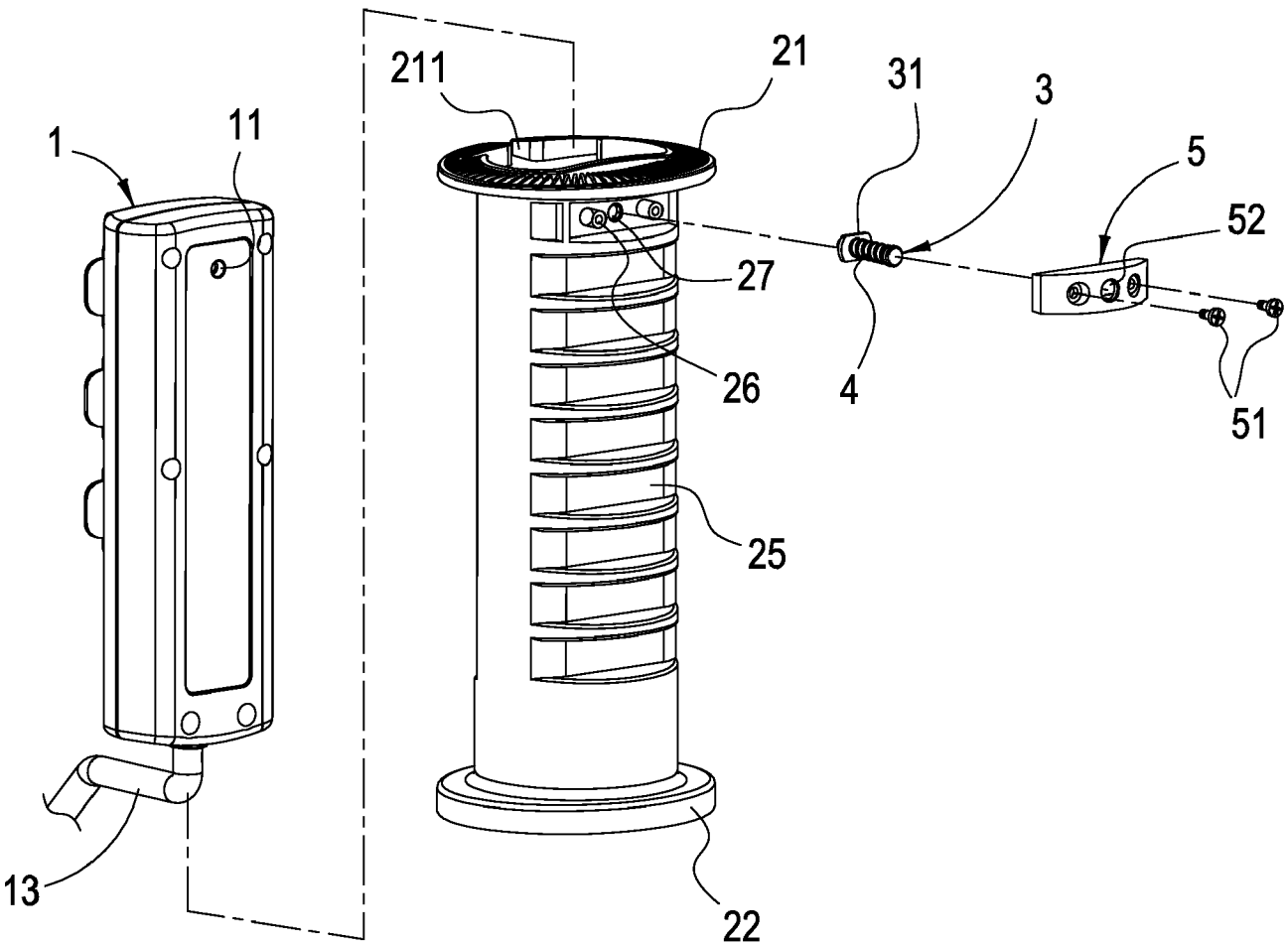
Figure 2:
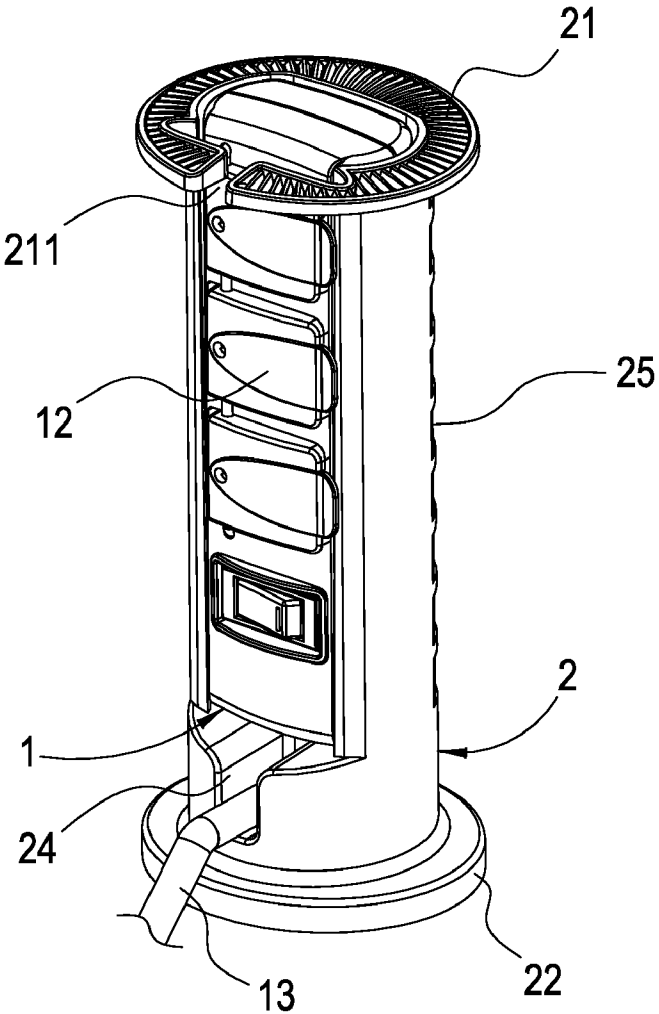
FIG. 2 illustrates a 3D diagram of the extension socket structure disclosed in the present invention.

Please refer to FIG. 1A, FIG. 1B and FIG. 2 for the extension socket structure disclosed in the present invention, which mainly comprises an extension socket 1 and a positioning sleeve 2.

The extension socket 1 has a positioning hole 11 disposed near the top end of the rear of extension socket 1.

The positioning sleeve 2 has a first rim 21 extending from a top end and a second rim 22 extending from a bottom end of the positioning sleeve. The first rim 21 has a slot 211 disposed thereon, an opening 23 is disposed on a front face of the positioning sleeve 2 and joining with the slot 211 of the first rim 21, an outlet 24 also joins with the opening 23 at the bottom of the opening 23, and a plurality of positioning slots 25 are equally spaced and disposed on a rear face of the positioning sleeve 2. Two parallelly-formed hollow rods 26 extend from the topmost one of the positioning slot 25 of the positioning sleeve 2 and have screw threads implemented therein. An axle hole 27 is disposed between two hollow rods 26 and has a bolt 3 protruded through it. A retaining plate 31 extends from the bolt 3 to divide the bolt 3 into a first half and a second half. The first half protrudes through the axle hole 27 of the positioning sleeve 2. The second half has a spring 4 wrapped around it, while one end of the spring 4 is retained by the retaining plate 32. A cover plate 5 joins with two hollow rods 26 of the positioning sleeve 2, and screws 51 go through the cover plate 5 and two hollow rods 26 to let the cover plate 5 closely joined with the positioning sleeve 2 near its top end of the rear face. With the second half of the bolt 3 protruding the through hole 52 of the cover plate 5, when the second half of the bolt 3 is pulled outwardly, the first half of the bolt 3 would come out of the axle hole 27 of the positioning sleeve 2. Meanwhile, the spring 4 of the bolt 3 is squeezed, therefore, when the second half of the bolt 3 is not being pulled, the bolt 3 would return to the original position by the elastic force of the spring 4.

The extension socket 1 is inserted in the positioning sleeve 2 for the first half of the bolt 3 near the top end of the rear of the positioning sleeve 2 to go through the positioning hole 11 on the rear of the extension socket 1 to fix the extension socket 1 firmly in position and for the extension socket 1 not to break away from the positioning sleeve 2 easily. The socket panel 112 on the extension socket 1 protrudes from the opening 23 of the positioning sleeve 2 to let a plug of an electrical appliance to plug in the extension socket 1, and an outlet 24 guides the power cable 13 of the extension socket 1 to extend out of the positioning sleeve 2.

Figure 3A:
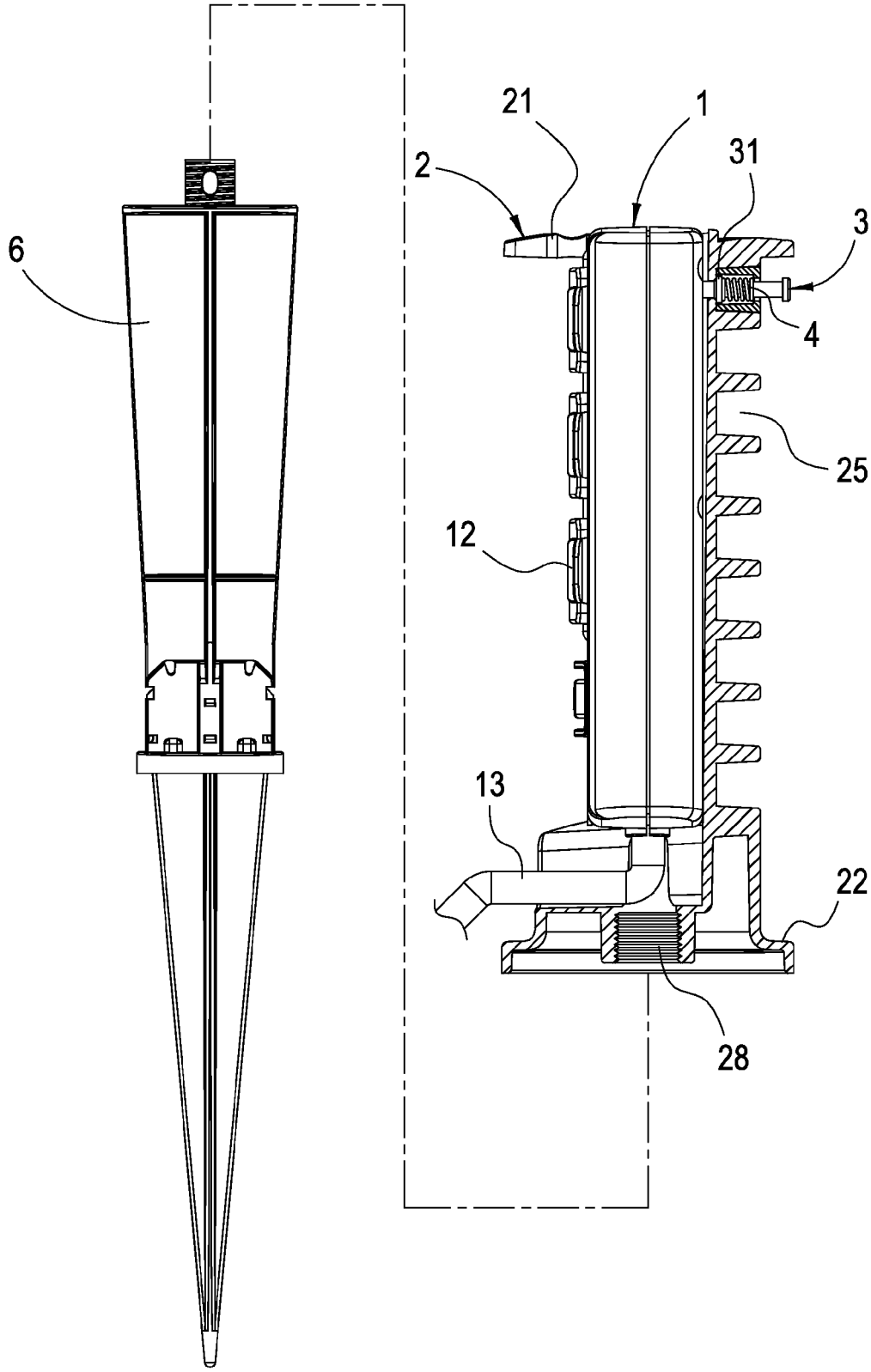
FIG. 3A and FIG. 3B illustrate a first embodiment of the extension socket structure.
Figure 3B:
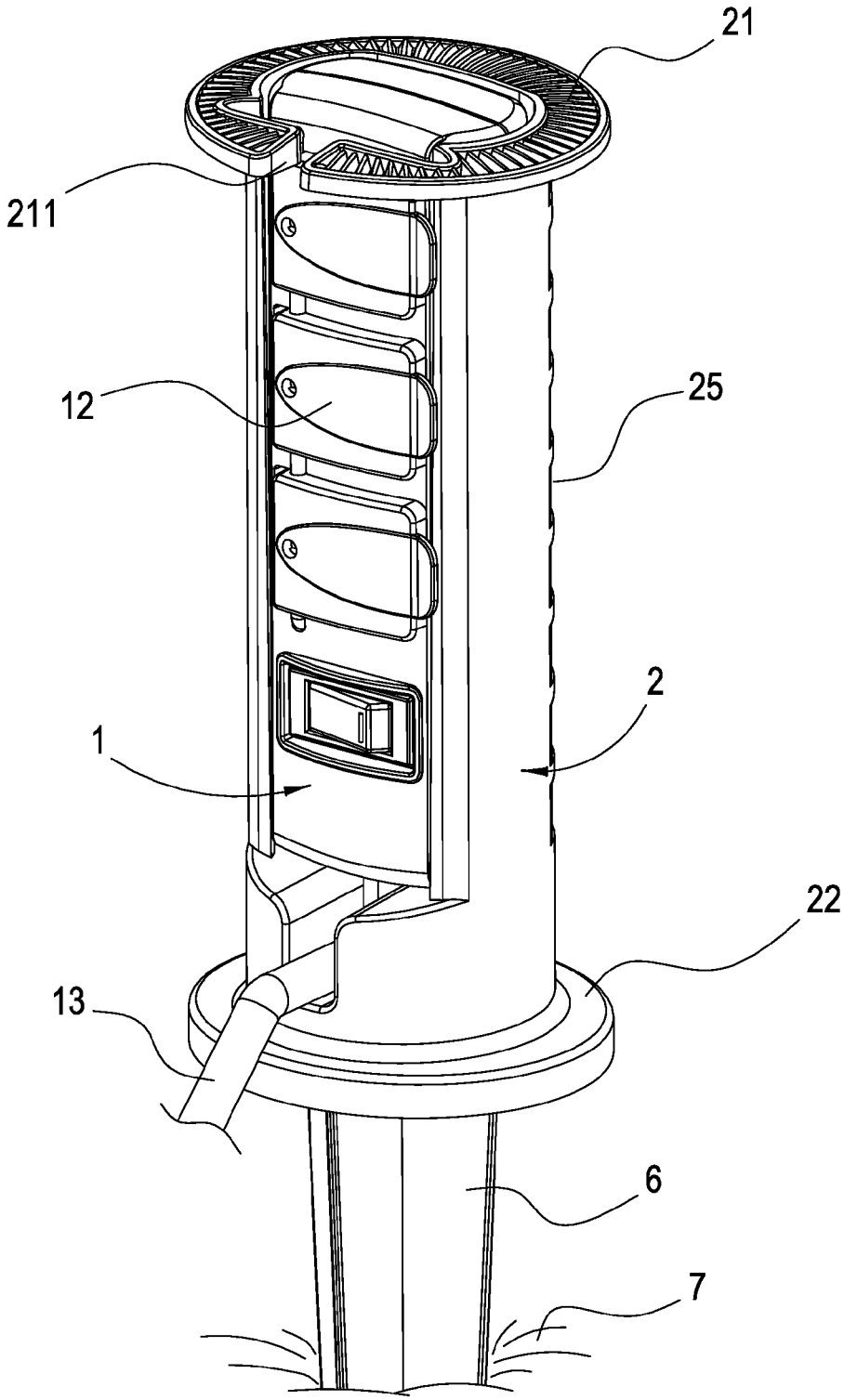

Please refer to FIG. 3A and FIG. 3B for a first embodiment of the present invention. A screw hole 28 can be disposed at the bottom of the positioning sleeve 2 for screwing a cone 6 thereto, and a user can insert the cone 6 into a lawn 7, a ground or sands to provide the extension socket 1 for outdoor use.

Figure 4A:
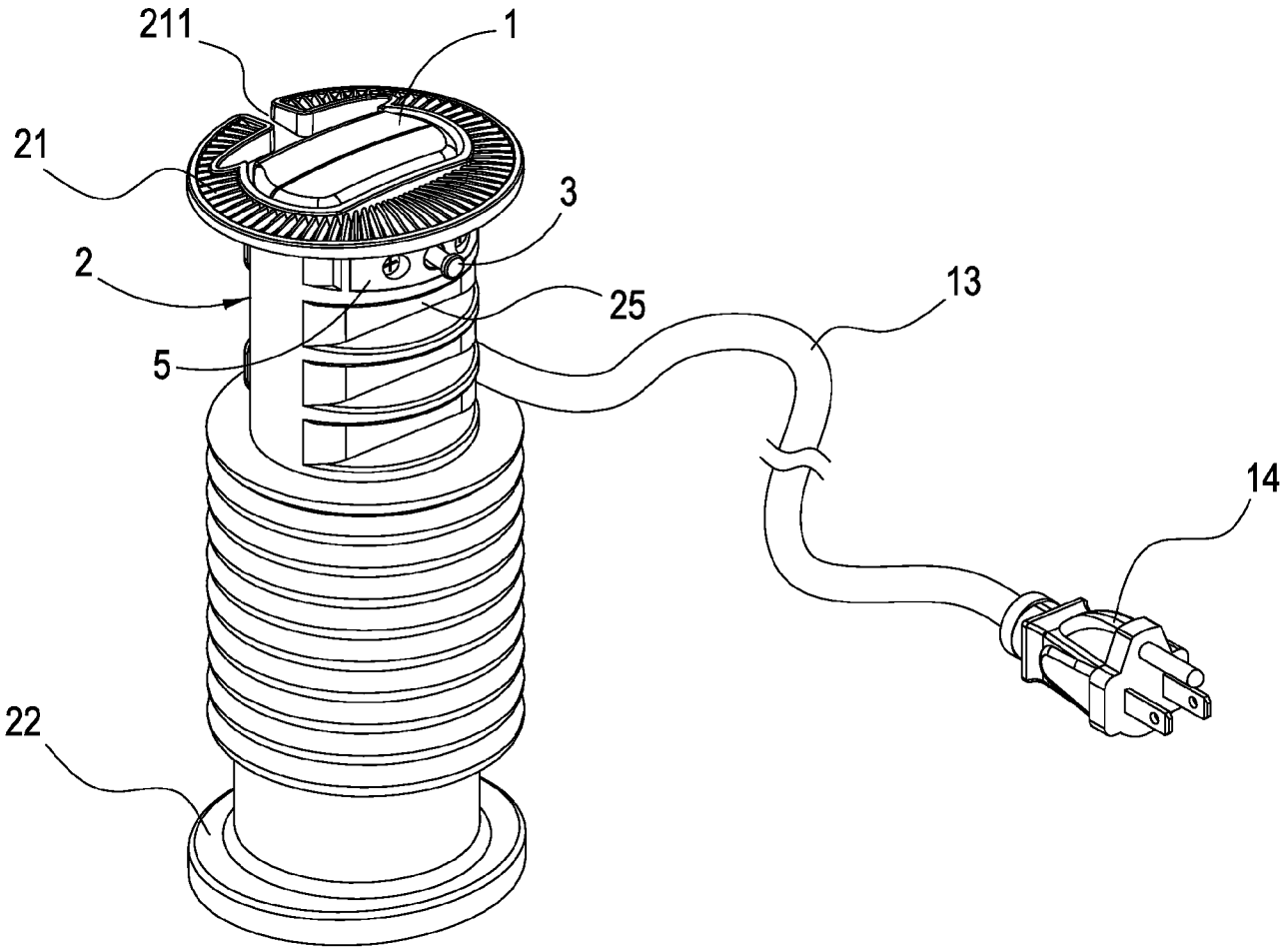
FIG. 4A and FIG. 4B illustrate a second embodiment of the extension socket structure.
Figure 4B:
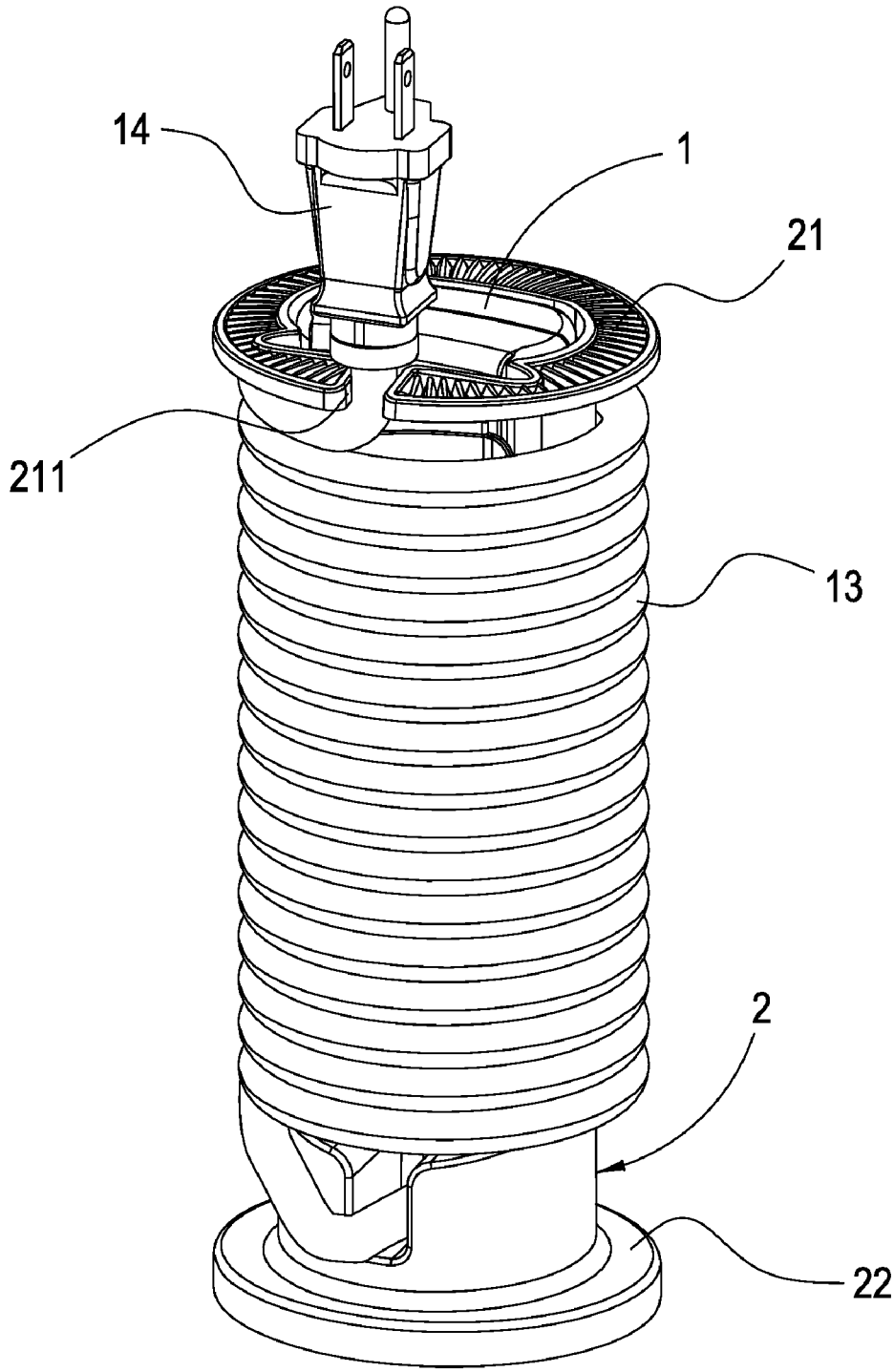

Please refer to FIG. 4A and FIG. 4B for a second embodiment of the present invent. When the extension slot 1 is not in use, a power cable 13 of the extension slot 1 can be wound around the positioning sleeve 2 from the bottom one of the positioning slot 25 to the top; therefore, the power cable 13 can be restrained by the positioning slot 25 to be neatly wound around the positioning sleeve 2. Finally, a plug 14 at the end of the power cable 13 is locked to the slot 211 of the first rim 21 on top of the positioning sleeve 2 to help organizing the power cable and to provide a convenient way for keeping the extension socket.

Furthermore, the extension socket 1 can be separated from the positioning sleeve 2 to be used indoors directly.

The present invention provides an extension socket structure, which compares with other traditional extension sockets, is advantageous in:

1. The present invention provides an extension socket structure, which places the extension socket inside a positioning sleeve and winds the power cable of the extension socket around the positioning sleeve to provide a convenient way to keep the extension socket.

2. The present invention provides an extension socket structure, which places the extension socket inside a positioning sleeve and has a cone screwed to the bottom of the positioning sleeve and implemented for fixing the extension socket to a lawn, a ground or sands to provide outdoor use.

3. The present invention provides an extension socket, which can be used indoors directly with any structural change.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An extension socket structure comprising:

an extension socket; and a positioning sleeve having a first rim extending from a top end and a second rim extending from a bottom end thereof, the first rim having a slot disposed thereon, an opening being disposed on a front face of the positioning sleeve, and a plurality of positioning slots being disposed on a rear face of the positioning sleeve, wherein the extension socket is inserted in the positioning sleeve for a socket panel on the extension socket to protrude from the opening of the positioning sleeve.

2. The extension socket structure of claim 1, wherein the positioning sleeve has a cone screwed to a bottom thereof, the cone being implemented for fixing the extension socket to a lawn, a ground or sand to provide outdoor use.

3. The extension socket structure of claim 1, wherein a wire of the extension socket is wound around the positioning sleeve and contained in the plurality of positioning slots, and a plug of the extension socket can be locked to the slot on the first rim of the top end of the positioning sleeve.

4. The extension socket structure of claim 1, wherein the extension socket has a positioning hole disposed near a top end of the rear face, and two parallelly-formed hollow rods extending from a topmost positioning slot of the positioning sleeve, with a cover plate covering two hollow rods, the cover plate being connected to a bolt, with a retaining plate extending from the bolt to divide the bolt into a first half and a second half, the first half of the bolt protruding through the positioning sleeve, the second half having a spring wrapped around the second half and protruded through the cover plate, when the extension socket combines with the positioning sleeve, the first half of the bolt joining with the positioning hole of the extension socket to fix the extension socket.

5. The extension socket structure of claim 1, wherein the positioning sleeve has an outlet joined to a bottom end of the opening of the front face, the outlet guiding a wire of the extension socket to extend out of the positioning sleeve.

* * * * *